US011103741B2

(12) United States Patent
Leoniak

(10) Patent No.: US 11,103,741 B2
(45) Date of Patent: Aug. 31, 2021

(54) ERGONOMIC EXERCISE GRIP STRUCTURE WITH DETACHABLE STRAP AND METHOD OF USE

(71) Applicant: James Leoniak, Toronto (CA)

(72) Inventor: James Leoniak, Toronto (CA)

( * ) Notice: Subject to any disclaimer, the term of this patent is extended or adjusted under 35 U.S.C. 154(b) by 0 days.

(21) Appl. No.: 16/229,752

(22) Filed: Dec. 21, 2018

(65) Prior Publication Data

US 2019/0184225 A1 Jun. 20, 2019

(51) Int. Cl.

| | |
|---|---|
| ***A63B 21/072*** | (2006.01) |
| ***A63B 21/00*** | (2006.01) |
| ***A63B 21/075*** | (2006.01) |
| ***A63B 21/16*** | (2006.01) |
| ***A63B 21/078*** | (2006.01) |

(52) U.S. Cl.

CPC ..... *A63B 21/4035* (2015.10); *A63B 21/075* (2013.01); *A63B 21/0724* (2013.01); *A63B 21/0783* (2015.10); *A63B 21/154* (2013.01); *A63B 21/16* (2013.01); *A63B 21/4049* (2015.10); *A63B 2225/093* (2013.01)

(58) Field of Classification Search

CPC ..... A63B 21/4035; A63B 21/0724; A63B 21/0783

See application file for complete search history.

(56) References Cited

U.S. PATENT DOCUMENTS

| | | | | |
|---|---|---|---|---|
| 2,508,567 A | | 5/1950 | Dymeck | |
| 4,018,442 A | | 4/1977 | Galler | |
| 4,274,628 A | | 6/1981 | Hoagland | |
| 4,312,506 A | | 1/1982 | Brennan | |
| 4,690,400 A | * | 9/1987 | Metz | A63B 21/015 482/106 |
| 4,709,922 A | * | 12/1987 | Slade, Jr. | A63B 21/0783 482/104 |
| 4,756,526 A | | 7/1988 | Broussard | |
| 4,880,229 A | | 11/1989 | Broussard | |

(Continued)

FOREIGN PATENT DOCUMENTS

| | | |
|---|---|---|
| CA | 2939605 | 11/2016 |
| EP | 0 730886 A1 | 11/1996 |

OTHER PUBLICATIONS

Hammer Strength 2020 Catalog (32 pages). Published in the United States by the Hammer Strength Company of Cincinnati.

*Primary Examiner* — Joshua T Kennedy

(57) ABSTRACT

A versatile ergonomic exercise grip structure with a detachable strap which is applicable to cable attachments, machine attachments, barbells and dumbbells. The ergonomic exercise grip structure is comprised of parallel bars which may be used interchangeably as a grip or support as they evenly share the resistance between them and may engage the body at several points to enable the performance of multiple exercises in a manner that reduces joint strain and improves muscle isolation while being capable providing multiple forms of resistance. The detachable strap enables the performance of multiple exercises with the ergonomic exercise grip structure while serving as a cable attachment by itself. The various embodiments of the ergonomic exercise grip structure enable a trainee to perform multiple exercise in a safe effective manner while using a minimal amount of space.

8 Claims, 28 Drawing Sheets

(56) References Cited

U.S. PATENT DOCUMENTS 5,024,434 A * 6/1991 Smith ..... A63B 21/0724 482/106
5,118,097 A 6/1992 Cousins
5,453,067 A 9/1995 Cianfrocca
5,554,089 A 9/1996 Jones
5,637,064 A 6/1997 Olson et al.
7,044,896 B2 5/2006 Hetrick
7,094,182 B1 * 8/2006 Holten ..... A63B 23/14 482/115
D535,336 S * 1/2007 Diakonov ..... D21/679
7,862,486 B1 9/2011 Watson
8,172,731 B1 5/2012 Bredda
8,574,136 B1 * 11/2013 Burstrom ..... A63B 69/0057 482/109
8,672,815 B1 * 3/2014 Springer ..... A63B 22/0046 482/106
8,951,170 B1 * 2/2015 Tayo ..... A63B 21/4035 482/107
10,159,868 B2 * 12/2018 Light ..... A63B 21/4049
10,888,731 B2 * 1/2021 Olmstead ..... A63B 21/0724
2003/0130096 A1 7/2003 LaCroce
2005/0202942 A1 * 9/2005 De Lano ..... A63B 21/0724 482/107
2007/0021270 A1 * 1/2007 Nugent ..... A63B 21/0783 482/8
2008/0020909 A1 * 1/2008 Blair ..... A63B 21/0783 482/69
2008/0176723 A1 * 7/2008 Johnson ..... A63B 21/4017 482/106
2008/0280738 A1 * 11/2008 Brennan ..... A63B 23/03525 482/129
2012/0214651 A1 * 8/2012 Ross ..... A63B 7/00 482/129
2013/0035218 A1 * 2/2013 Wierszewski ..... A63B 21/072 482/106
2014/0073493 A1 * 3/2014 Parish ..... A63B 21/0783 482/104
2014/0287889 A1 * 9/2014 Grace ..... A63B 71/0036 482/106
2016/0051857 A1 2/2016 Rasner
2016/0263461 A1 * 9/2016 Kay ..... A63B 24/0087
2019/0099634 A1 * 4/2019 Sanseverino ..... A63B 23/12
2019/0269960 A1 * 9/2019 Barrow ..... A63B 21/4039

* cited by examiner

ERGONOMIC EXERCISE GRIP STRUCTURE WITH DETACHABLE STRAP AND METHOD OF USE

FIELD OF THE INVENTION

The present invention relates to an improvement to an apparatus in the field of weight training, specifically, an ergonomic exercise grip structure with a detachable strap which can be applied to cable attachments, machine attachments, barbells and dumbbells which enhances the performance of a number of exercises by reducing joint strain and discomfort while providing enhanced muscle stimulation.

SUMMARY OF THE INVENTION

Today, there are many different types of barbells, dumbbells, machine and cable attachments that are available to trainees. Despite the variety of available solutions, most of these items fit into three categories: straight bar structures, Swiss bar structures and specialty/ergonomic bars and attachments.

The barbells, dumbbells, machine and cable attachments in these categories have their respective benefits and drawbacks as one type of item cannot perform the functions of all of the others and trainees need a variety of items to achieve their training goals.

Besides straight bar structures, Swiss bar structures and specialty/ergonomic bars and attachments, there are also exercise devices that comprise an adjustable strap or set of straps that enable the trainee to perform exercises using their own bodyweight.

Trainees and athletic facilities would benefit from an exercise system that offers multiple ergonomic grips and forms of resistance while being able to function as a barbell, cable or machine attachment or dumbbell while providing an adjustable strap that enables the performance of a multitude of exercises in a safe effective manner. This would be more cost effective as one system would satisfy the needs of several attachments in one unit while adding greater functionality to existing equipment without using any additional space.

Canadian Patent 2,939,605 to the Applicant James Leoniak, the disclosure of which patent is incorporated into the present disclosure, partly addresses these needs. The present application is an improved apparatus that provides the benefits of straight bar structures, Swiss bar structures and specialty/ergonomic bars and attachments along with an adjustable strap to provide trainees with the benefits of all of these devices while minimizing their respective drawbacks and providing greater versatility and functionality.

BRIEF DESCRIPTION OF THE DRAWINGS

Table 1 below describes the numbering of the components of the various embodiments of the ergonomic exercise grip structure with a detachable strap.

TABLE 1

| COMPONENT | NUMBER |
|---|---|
| Parallel Bars | 1 |
| Flat Join Plate | 2 |
| Eyelet | 3 |
| Weight Bearing Rod | 4 |
| Stirrup Handle with Grip (All Shown as circular) | 5 |
| Grip inside Stirrup Handle | 6 |

TABLE 1-continued

| COMPONENT | NUMBER |
|---|---|
| Flat Elongated Strap | 7 |
| Metal Wringed Eyelet | 8 |
| Carabiner | 9 |

The majority of the drawings below depict the parallel bars 1 as being straight while depicting all stirrup handles 5 in the circular format with neutral grips 6 for presentation purposes, however, as described in Table 2 below and in the detailed description that follows, there are several formats for these elements and the drawings are only intended to disclose the essence of the invention without limiting it thereto or thereby.

Figure 1A:
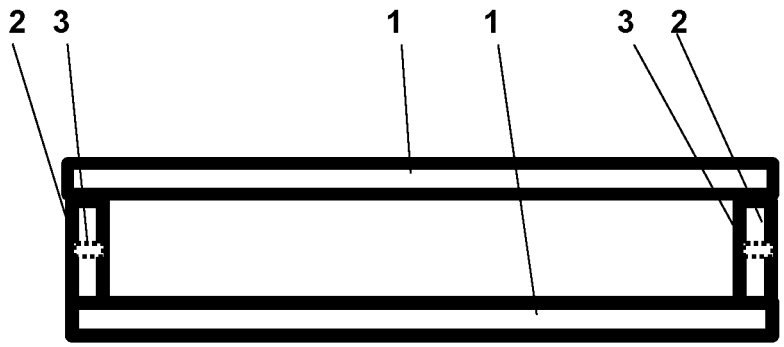

FIG. 1A is a top/bottom view of the ergonomic exercise grip structure as a cable attachment. This embodiment may attach to a dual cable pulley structure with the eyelets 3 in the center of the flat join plates 2 at the end of the parallel bars 1.

Figure 1B:
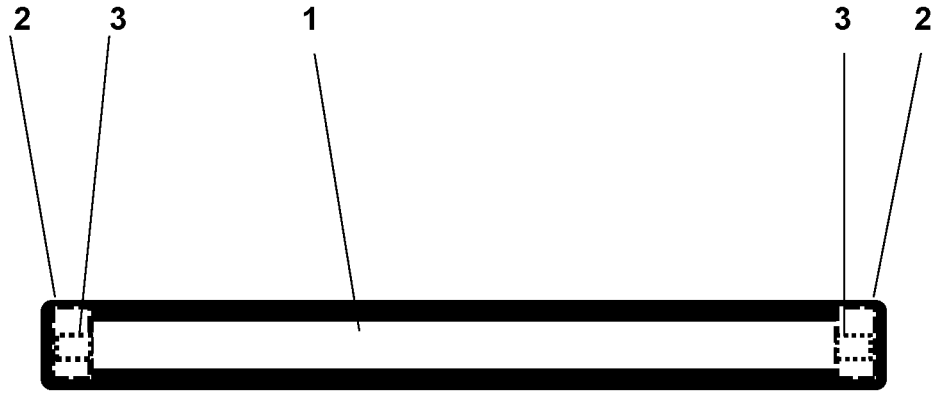

FIG. 1B is a front/back view of the of the cable attachment embodiment of the ergonomic exercise grip structure. The flat join plates 2 and eyelets in their center 3 are marked by hashed lines as they would not be visible to the naked eye.

Figure 1C:
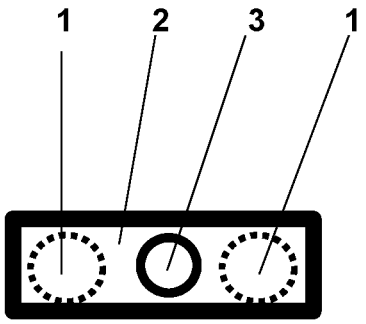

FIG. 1C is a side view of the of the cable attachment embodiment of the ergonomic exercise grip structure. The parallel bars 1 are marked by hashed lines as they would not be visible to the naked eye.

Figure 1D:
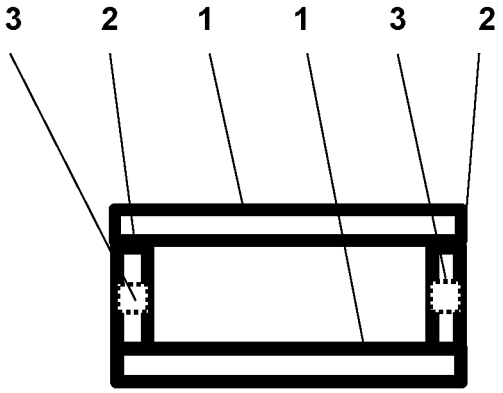

FIG. 1D is a top/bottom view of the cable attachment with shorter parallel bars 1 taking the form of a single hand cable attachment.

Figure 2A:
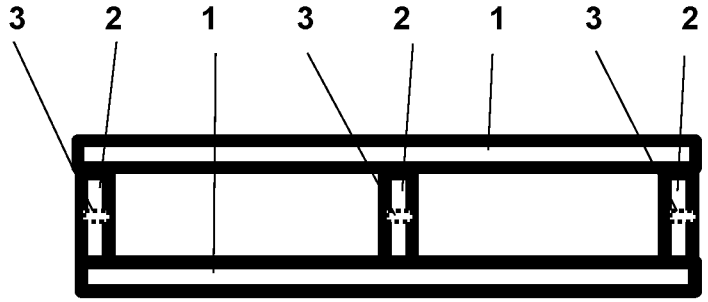

FIG. 2A is a top/bottom view of the ergonomic exercise grip structure as a cable attachment which may attach to a single cable pulley structure with the center eyelet 3 in the center flat join plate 2 or to a dual cable structure with the eyelets 3 in the flat join plates 2 at the end of the parallel bars 1.

Figure 2B:
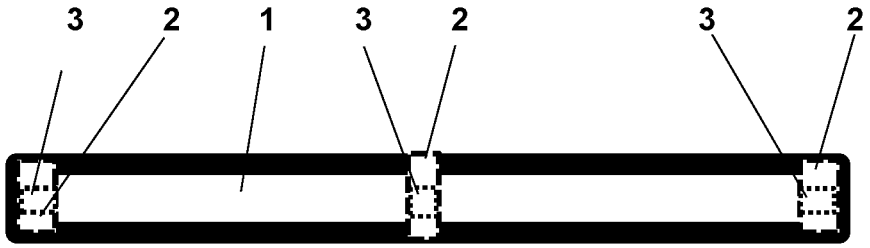

FIG. 2B is a front/back view of the of the cable attachment embodiment of the ergonomic exercise grip structure with stirrup handles 5. The grip bars 6 inside the stirrup handles 5 are marked by hashed lines as they would not be visible to the naked eye.

Figure 2C:
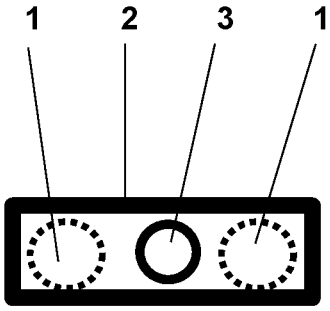

FIG. 2C is a side view of the of the cable attachment embodiment of the ergonomic exercise grip structure. The grip bars 6 inside the stirrup handles 5 are marked by hashed lines as they would not be visible to the naked eye.

Figure 3A:
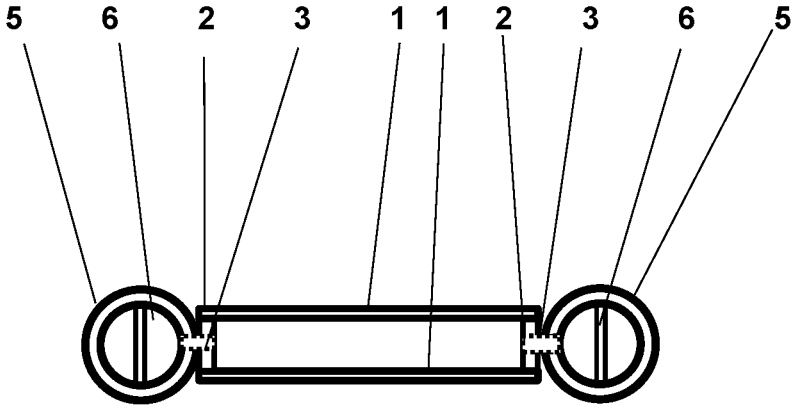

FIG. 3A is a top/bottom view of the ergonomic exercise grip structure as a cable attachment with stirrup handles 5 with grips 6 in the neutral position.

Figure 3B:
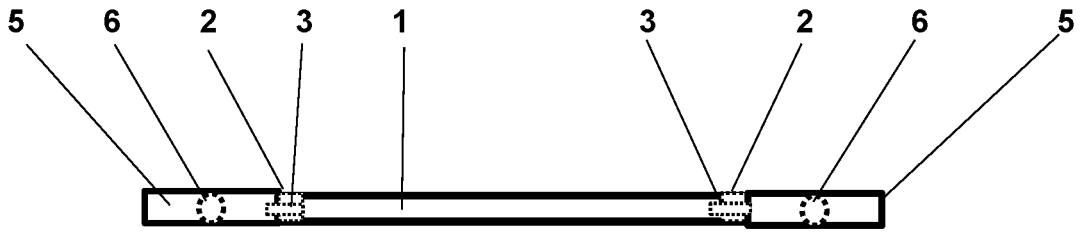

FIG. 3B is a front/back view of the ergonomic exercise grip structure as a cable attachment with stirrup handles 5.

Figure 3C:
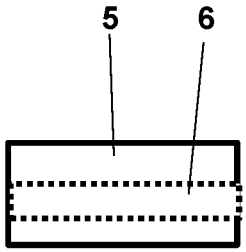

FIG. 3C is a side view of the ergonomic exercise grip structure as a cable attachment with stirrup handles 5.

Figure 3D:
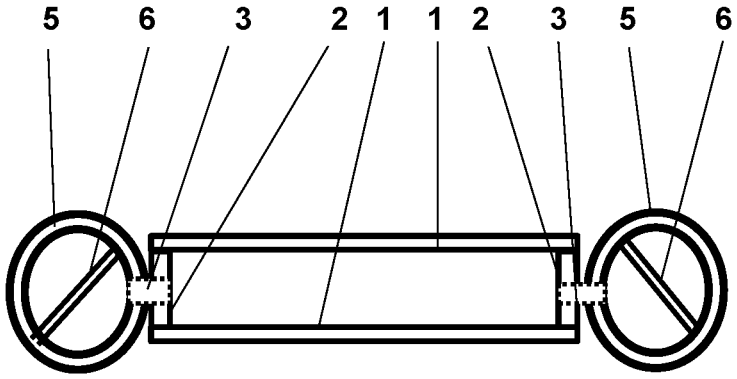

FIG. 3D is a top/bottom view of the ergonomic exercise grip structure as a cable attachment with stirrup handles 5 with grips 6 in the diagonal position.

Figure 3E:
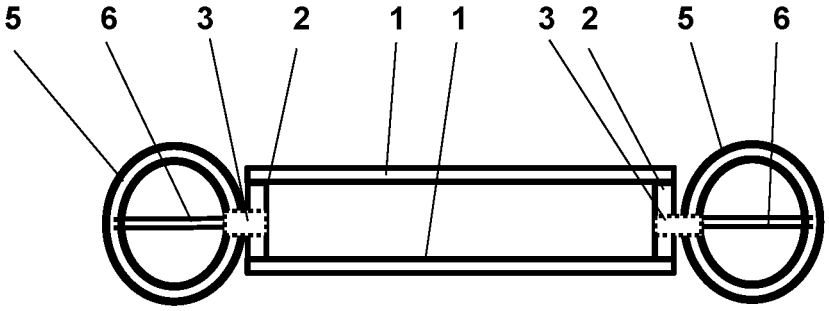

FIG. 3E is a top/bottom view of the ergonomic exercise grip structure as a cable attachment with stirrup handles 5 with grips 6 in the standard position.

Figure 3F:
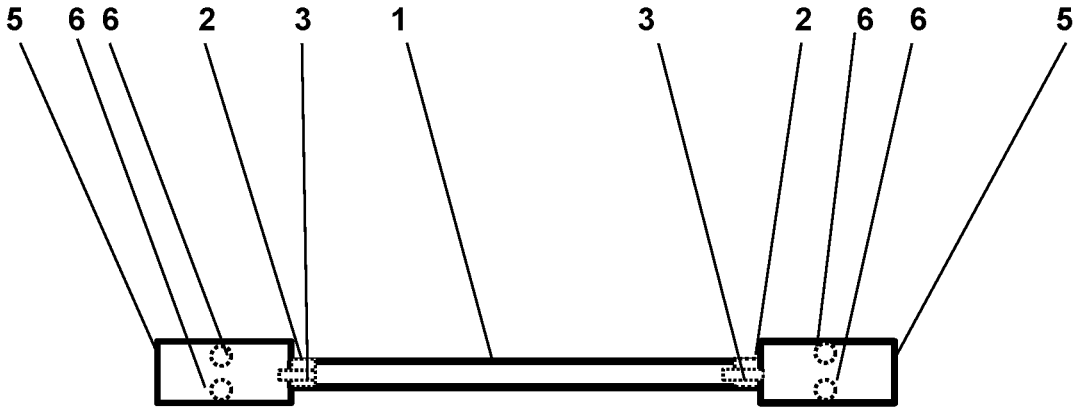

FIG. 3F is a front/back view of the ergonomic exercise grip structure as a cable attachment with stirrup handles 5 with dual grips 6 in the neutral position.

Figure 3G:
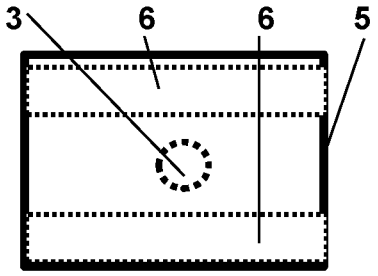

FIG. 3G is a side view of the ergonomic exercise grip structure as a cable attachment with stirrup handles 5 with dual grips 6 in the neutral position.

Figure 4A:
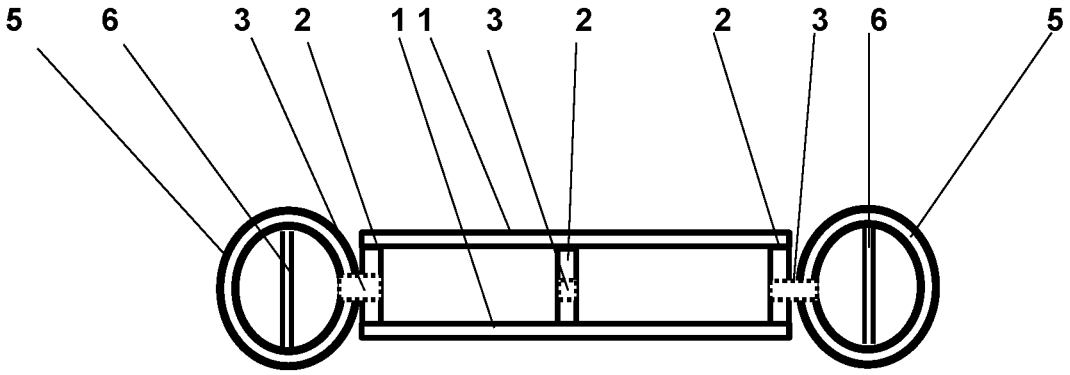

FIG. 4A is a top/bottom view of the ergonomic exercise grip structure as a cable attachment with stirrup handles 5 with grips 6 in the neutral position and a flat join plate 2 with an eyelet 3 in its center connecting the parallel bars 1 in the middle.

Figure 4B:
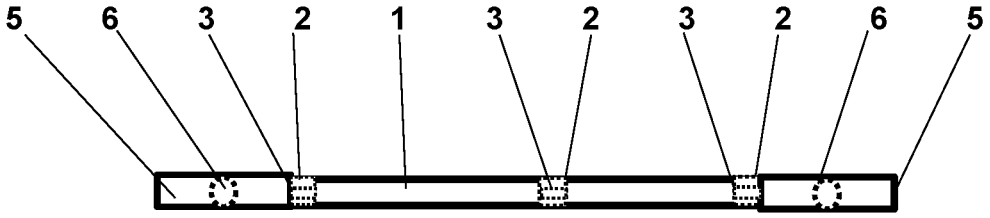

FIG. 4B is a front/back view of the ergonomic exercise grip structure as a cable attachment with stirrup handles 5 and a flat join plate 2 with an eyelet 3 in its center connecting the parallel bars 1 in the middle.

Figure 4C:
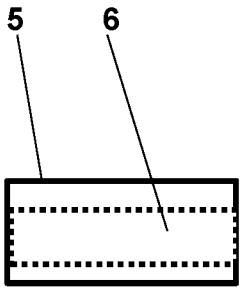

FIG. 4C is a side view of the ergonomic exercise grip structure as a cable attachment with stirrup handles 5 and a flat join plate 2 with an eyelet 3 in its center connecting the parallel bars 1 in the middle.

Figure 4D:
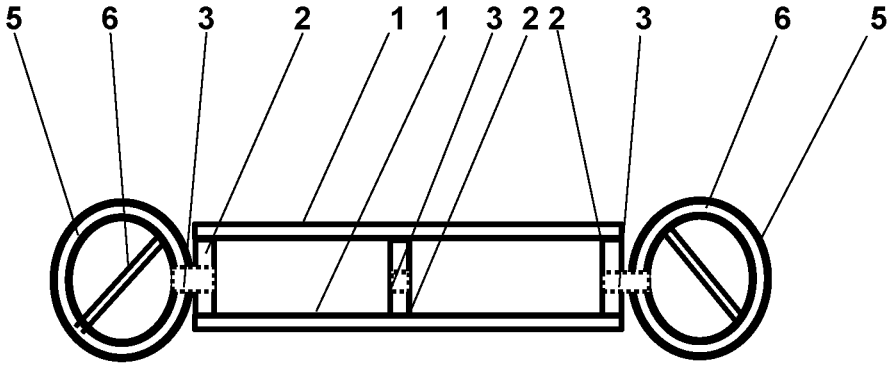

FIG. 4D is a top/bottom view of the ergonomic exercise grip structure as a cable attachment with stirrup handles 5 with grips 6 in the diagonal position along with a flat join plate 2 with an eyelet 3 in its center connecting the parallel bars 1 in the middle.

Figure 4E:
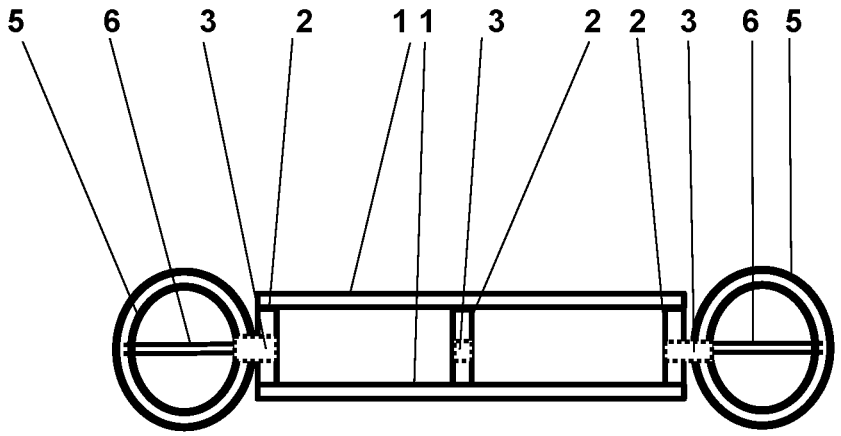

FIG. 4E is a top/bottom view of the ergonomic exercise grip structure as a cable attachment with stirrup handles 5 with grips 6 in the standard position along with a flat join plate 2 with an eyelet 3 in its center connecting the parallel bars 1 in the middle.

Figure 4F:
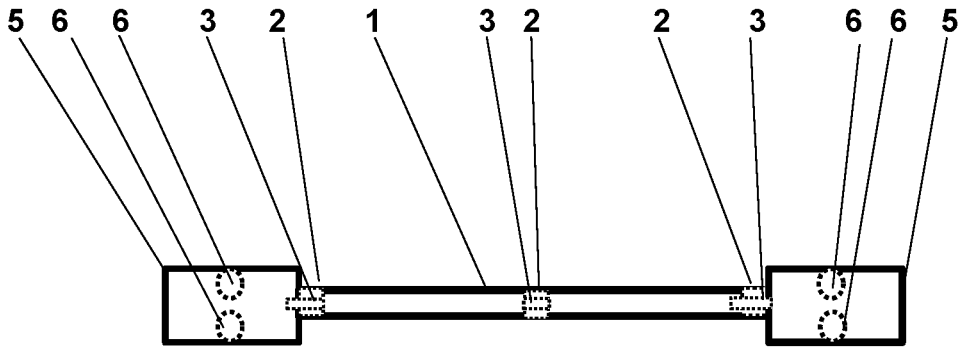

FIG. 4F is a front/back view of the ergonomic exercise grip structure as a cable attachment with stirrup handles 5 with dual grips 6 in the neutral position along with a flat join plate 2 with an eyelet 3 in its center connecting the parallel bars 1 in the middle.

Figure 4G:
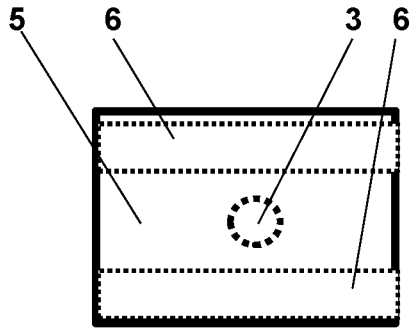

FIG. 4G is a side view of the ergonomic exercise grip structure as a cable attachment with stirrup handles 5 with dual grips 6 in the neutral position along with a flat join plate 2 with an eyelet 3 in its center connecting the parallel bars 1 in the middle.

Figure 5A:
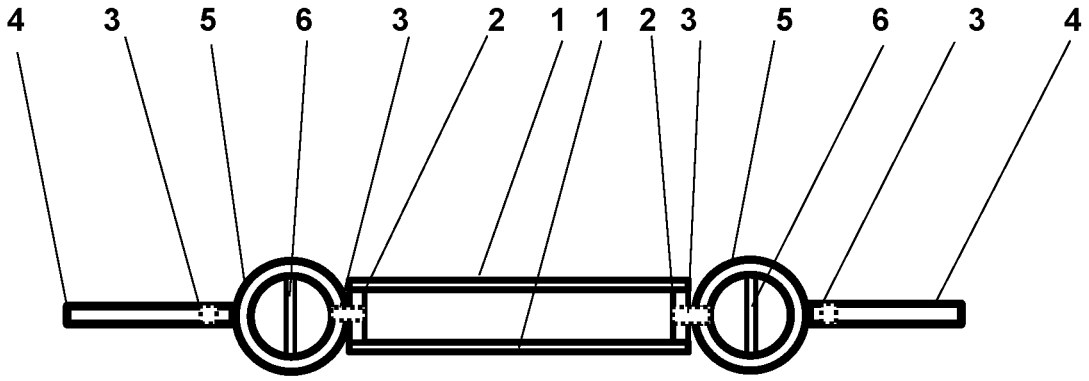

FIG. 5A is a top/bottom view of the ergonomic exercise grip structure as a cable attachment with stirrup handles 5 with grips 6 in the neutral position with 1 or 2 inch diameter standard or Olympic weight bearing rods 4 that have an eyelet 3 in the center of their inside ends which is perpendicular to the parallel bars 1.

Figure 5B:
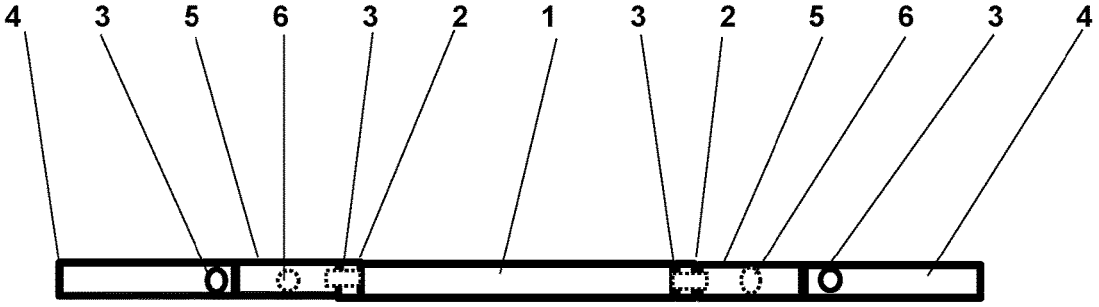

FIG. 5B is a front/back view of the ergonomic exercise grip structure as a cable attachment with stirrup handles 5 with 1 or 2 inch diameter standard or Olympic weight bearing rods 4 that have an eyelet 3 in the center of their inside ends which is perpendicular to the parallel bars 1.

Figure 5C:
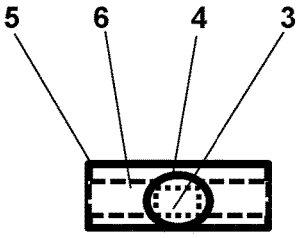

FIG. 5C is a side view of the ergonomic exercise grip structure as a cable attachment with stirrup handles 5 with 1 or 2 inch diameter standard or Olympic weight bearing rods 4 that have an eyelet 3 in the center of their inside ends which is perpendicular to the parallel bars 1.

Figure 5D:
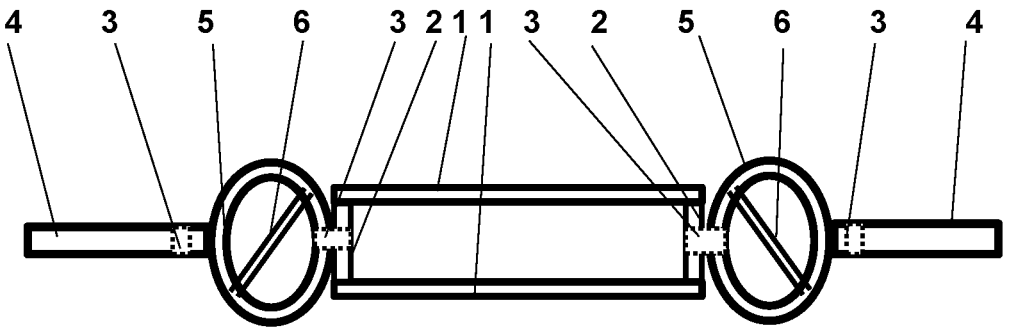

FIG. 5D is a top/bottom view of the ergonomic exercise grip structure as a cable attachment with stirrup handles 5 with grips 6 in the diagonal position with 1 or 2 inch diameter standard or Olympic weight bearing rods 4 that have an eyelet 3 in the center of their inside ends which is perpendicular to the parallel bars 1.

Figure 5E:
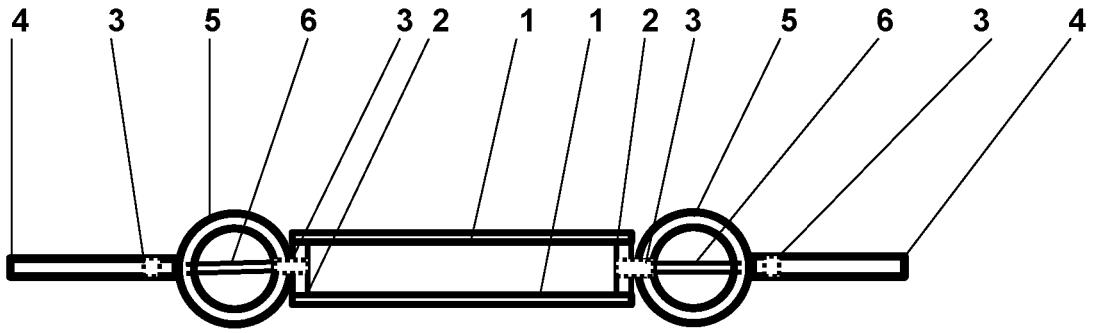

FIG. 5E is a top/bottom view of the ergonomic exercise grip structure as a cable attachment with stirrup handles 5 with grips 6 in the standard position with 1 or 2 inch diameter standard or Olympic weight bearing rods 4 that have an eyelet 3 in the center of their inside ends which is perpendicular to the parallel bars 1.

Figure 5F:
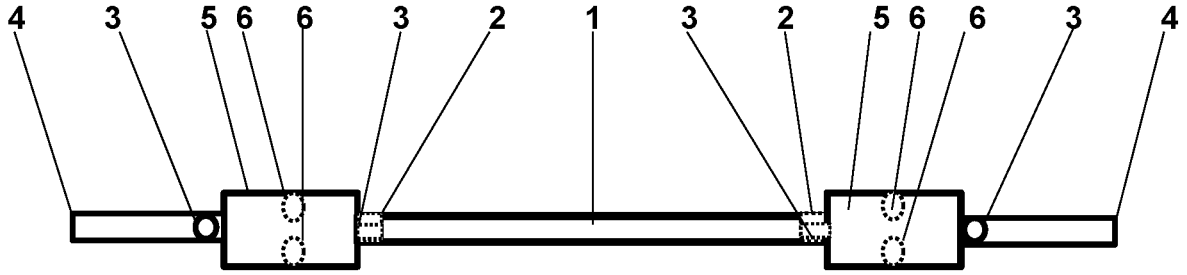

FIG. 5F is a front/back view of the ergonomic exercise grip structure as a cable attachment with stirrup handles 5 with dual grips 6 in the neutral position with 1 or 2 inch diameter standard or Olympic weight bearing rods 4 that have an eyelet 3 in the center of their inside ends which is perpendicular to the parallel bars 1.

Figure 5G:
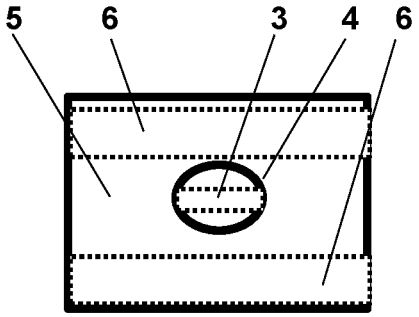

FIG. 5G is a side view of the ergonomic exercise grip structure as a cable attachment with stirrup handles 5 with dual grips 6 in the neutral position with 1 or 2 inch diameter standard or Olympic weight bearing rods 4 that have an eyelet 3 in the center of their inside ends which is perpendicular to the parallel bars 1.

Figure 6A:
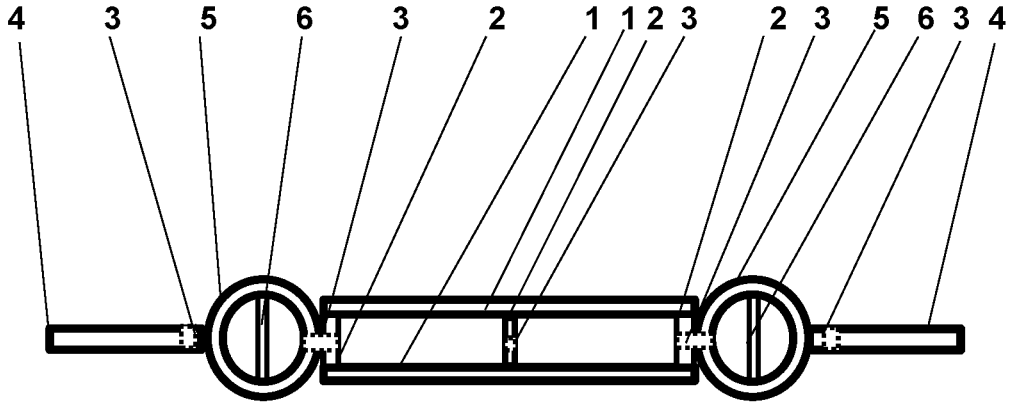

FIG. 6A is a top/bottom view of the ergonomic exercise grip structure as a cable attachment with stirrup handles 5 with grips 6 in the neutral position with 1 or 2 inch diameter standard or Olympic weight bearing rods 4 that have an eyelet 3 in the center of their inside ends which is perpendicular to the parallel bars 1 and a flat join plate 2 with an eyelet 3 in its center connecting the parallel bars 1 in the middle.

Figure 6B:
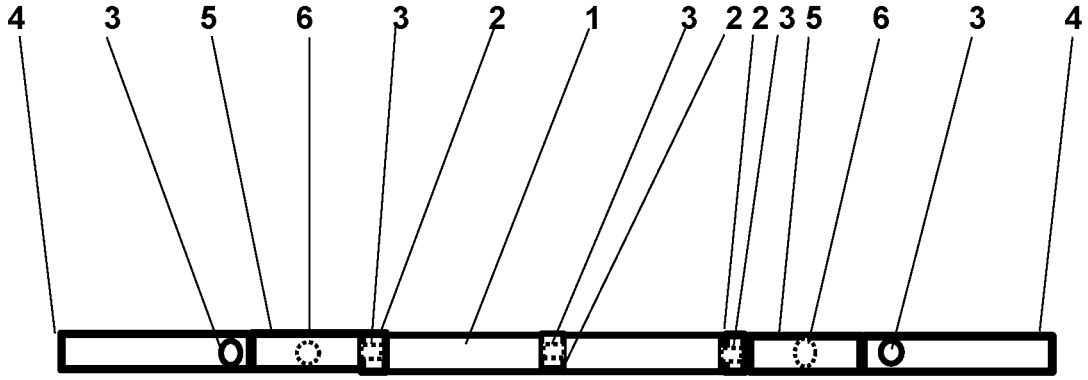

FIG. 6B is a front/back view of the ergonomic exercise grip structure as a cable attachment with stirrup handles 5 with 1 or 2 inch diameter standard or Olympic weight bearing rods 4 that have an eyelet 3 in the center of their inside ends which is perpendicular to the parallel bars 1 and a flat join plate 2 with an eyelet 3 in its center connecting the parallel bars 1 in the middle.

Figure 6C:
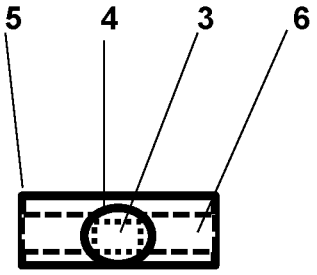

FIG. 6C is a side view of the ergonomic exercise grip structure as a cable attachment with stirrup handles 5 with 1 or 2 inch diameter standard or Olympic weight bearing rods 4 that have an eyelet 3 in the center of their inside ends which is perpendicular to the parallel bars 1 and a flat join plate 2 with an eyelet 3 in its center connecting the parallel bars 1 in the middle.

Figure 6D:
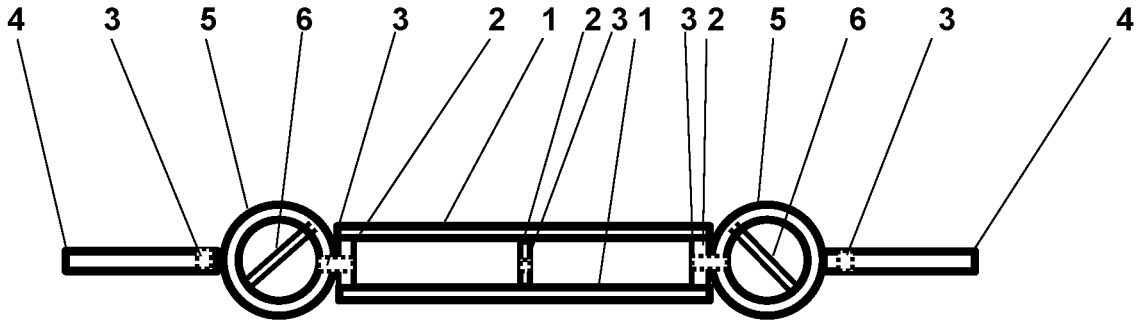

FIG. 6D is a top/bottom view of the ergonomic exercise grip structure as a cable attachment with stirrup handles 5 with grips 6 in the diagonal position with 1 or 2 inch diameter standard or Olympic weight bearing rods 4 that have an eyelet 3 in the center of their inside ends which is perpendicular to the parallel bars 1 and a flat join plate 2 with an eyelet 3 in its center connecting the parallel bars 1 in the middle.

Figure 6E:
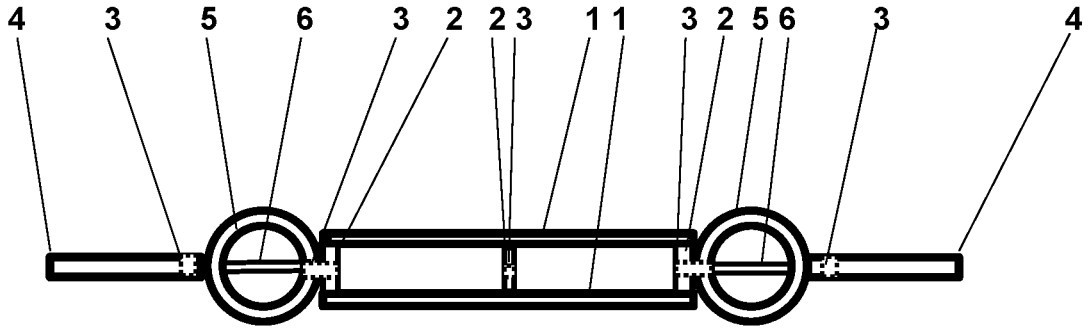

FIG. 6E is a top/bottom view of the ergonomic exercise grip structure as a cable attachment with stirrup handles 5 with grips 6 in the standard position with 1 or 2 inch diameter standard or Olympic weight bearing rods 4 that have an eyelet 3 in the center of their inside ends which is perpendicular to the parallel bars 1 and a flat join plate 2 with an eyelet 3 in its center connecting the parallel bars 1 in the middle.

Figure 6F:
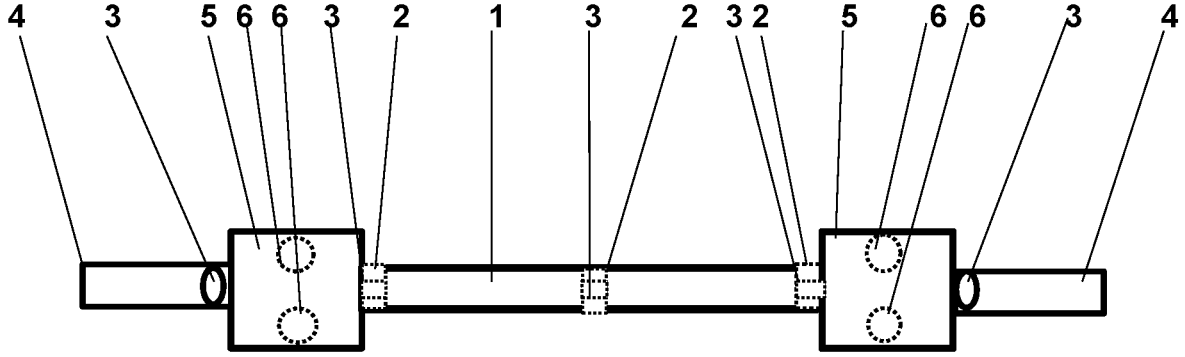

FIG. 6F is a front/back view of the ergonomic exercise grip structure as a cable attachment with stirrup handles 5 with dual grips 6 in the neutral position with 1 or 2 inch diameter standard or Olympic weight bearing rods 4 that have an eyelet 3 in the center of their inside ends which is perpendicular to the parallel bars 1 and a flat join plate 2 with an eyelet 3 in its center connecting the parallel bars 1 in the middle.

Figure 6G:
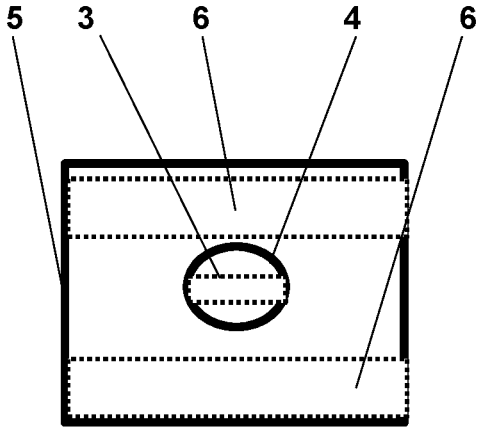

FIG. 6G is a side view of the ergonomic exercise grip structure as a cable attachment with stirrup handles 5 with dual grips 6 in the neutral position with 1 or 2 inch diameter standard or Olympic weight bearing rods 4 that have an eyelet 3 in the center of their inside ends which is perpendicular to the parallel bars 1 and a flat join plate 2 with an eyelet 3 in its center connecting the parallel bars 1 in the middle.

Figure 7A:
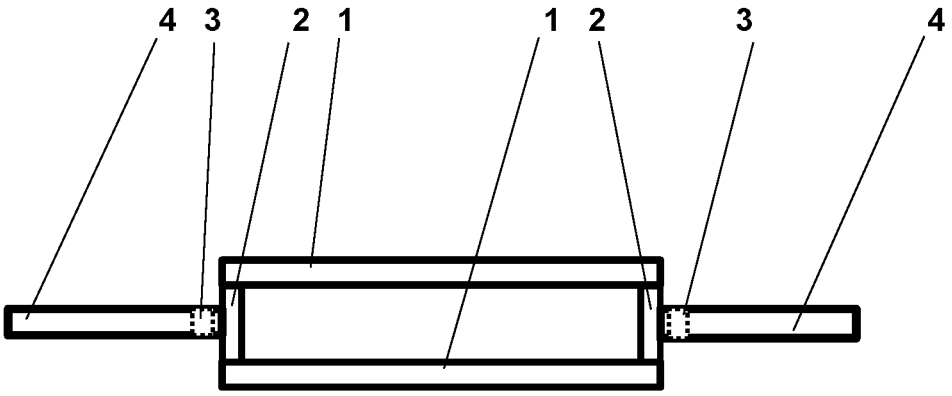

FIG. 7A is a top/bottom view of the ergonomic exercise grip structure as a barbell with 1 or 2 inch diameter standard or Olympic weight bearing rods 4 that have an eyelet 3 in the center of their inside ends which is perpendicular to the parallel bars 1.

Figure 7B:
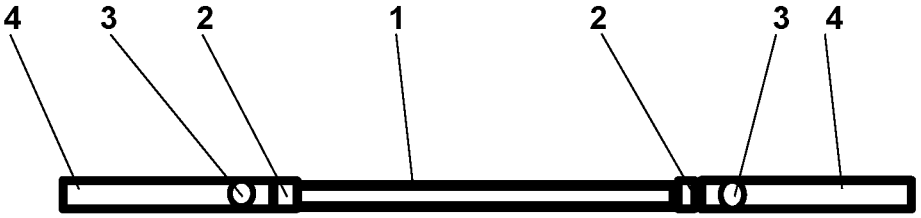

FIG. 7B is a front/back view of the ergonomic exercise grip structure as a barbell with 1 or 2 inch diameter standard or Olympic weight bearing rods 4 that have an eyelet 3 in the center of their inside ends which is perpendicular to the parallel bars 1.

Figure 7C:
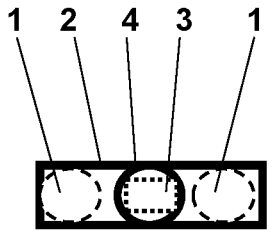

FIG. 7C is a side view of the ergonomic exercise grip structure as a barbell with 1 or 2 inch diameter standard or Olympic weight bearing rods 4 that have an eyelet 3 in the center of their inside ends which is perpendicular to the parallel bars 1.

Figure 7D:
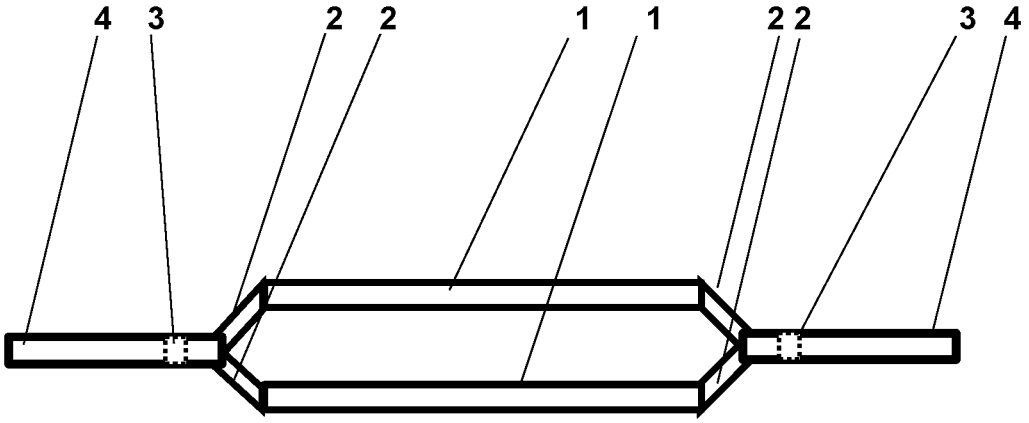

FIG. 7D is a top/bottom view of the ergonomic exercise grip structure as a barbell with 1 or 2 inch diameter standard or Olympic weight bearing rods 4 that have an eyelet 3 in the center of their inside ends which is perpendicular to the parallel bars 1. The parallel bars 1 are bent towards each other so they will attach directly to the weight bearing rods 4 in a triangular pattern.

Figure 8A:
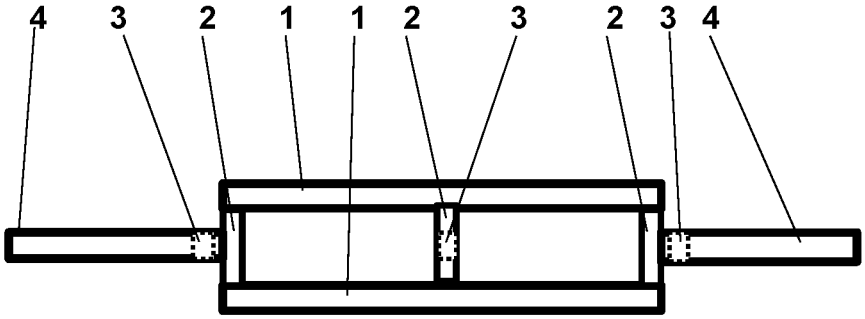

FIG. 8A is a top/bottom view of the ergonomic exercise grip structure as a barbell with 1 or 2 inch diameter standard or Olympic weight bearing rods 4 that have an eyelet 3 in the center of their inside ends which is perpendicular to the parallel bars 1 and a flat join plate 2 with an eyelet 3 in its center connecting the parallel bars 1 in the middle.

Figure 8B:
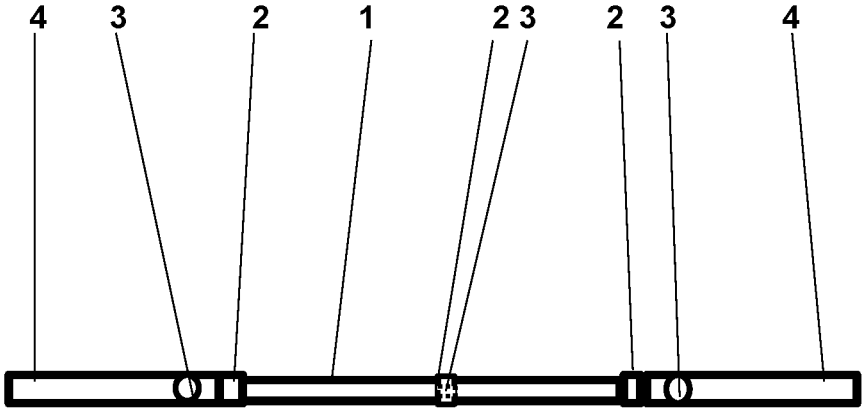

FIG. 8B is a front/back view of the ergonomic exercise grip structure as a barbell with 1 or 2 inch diameter standard or Olympic weight bearing rods 4 that have an eyelet 3 in the center of their inside ends which is perpendicular to the parallel bars 1 and a flat join plate 2 with an eyelet 3 in its center connecting the parallel bars 1 in the middle.

Figure 8C:
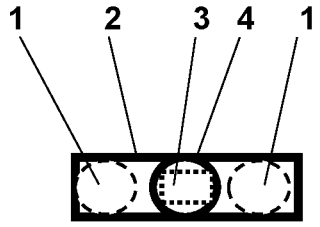

FIG. 8C is a side view of the ergonomic exercise grip structure as a barbell with 1 or 2 inch diameter standard or Olympic weight bearing rods 4 that have an eyelet 3 in the center of their inside ends which is perpendicular to the parallel bars 1 and a flat join plate 2 with an eyelet 3 in its center connecting the parallel bars 1 in the middle.

Figure 9A:
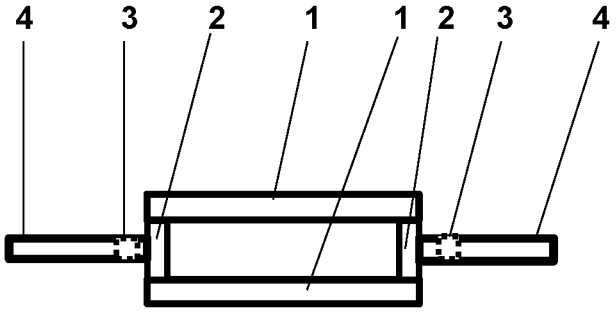

FIG. 9A is a top/bottom view of the ergonomic exercise grip structure as a dumbbell with 1 or 2 inch diameter standard or Olympic weight bearing rods 4 that have an eyelet 3 in the center of their inside ends which is perpendicular to the parallel bars 1.

Figure 9B:
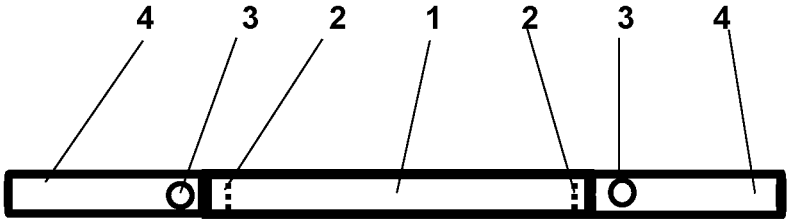

FIG. 9B is a front/back view of the ergonomic exercise grip structure as a dumbbell with 1 or 2 inch diameter standard or Olympic weight bearing rods 4 that have an eyelet 3 in the center of their inside ends which is perpendicular to the parallel bars 1.

Figure 9C:
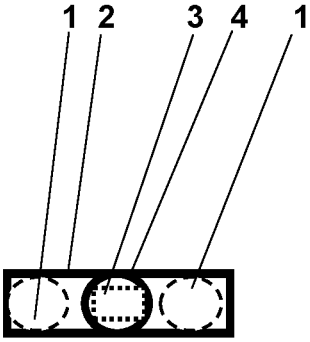

FIG. 9C is a front/back view of the ergonomic exercise grip structure as a dumbbell with 1 or 2 inch diameter standard or Olympic weight bearing rods 4 that have an eyelet 3 in the center of their inside ends which is perpendicular to the parallel bars 1.

Figure 10A:
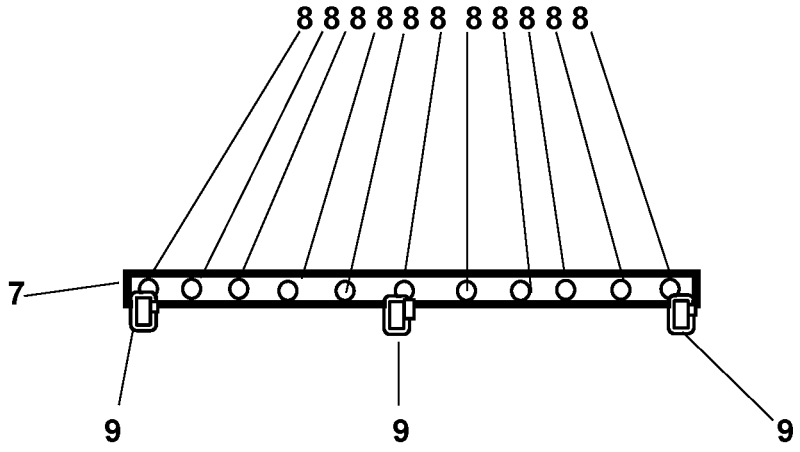

FIG. 10A is a top/bottom view of the inelastic flat strap 7 with metal wringed eyelets 8 and set of carabiners.

Figure 10B:
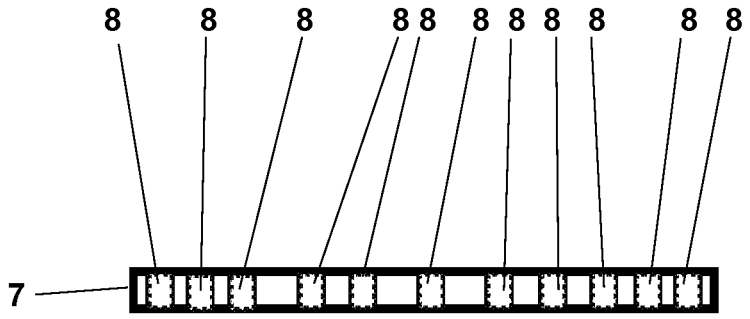

FIG. 10B is a front/back view of the inelastic flat strap 7 with metal wringed eyelets 8 and set of carabiners.

Figure 10C:
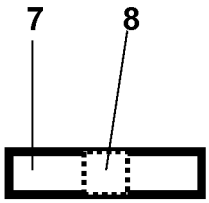

FIG. 10C is a side view of the inelastic flat strap 7 with metal wringed eyelets 8 and set of carabiners.

Figure 11A:
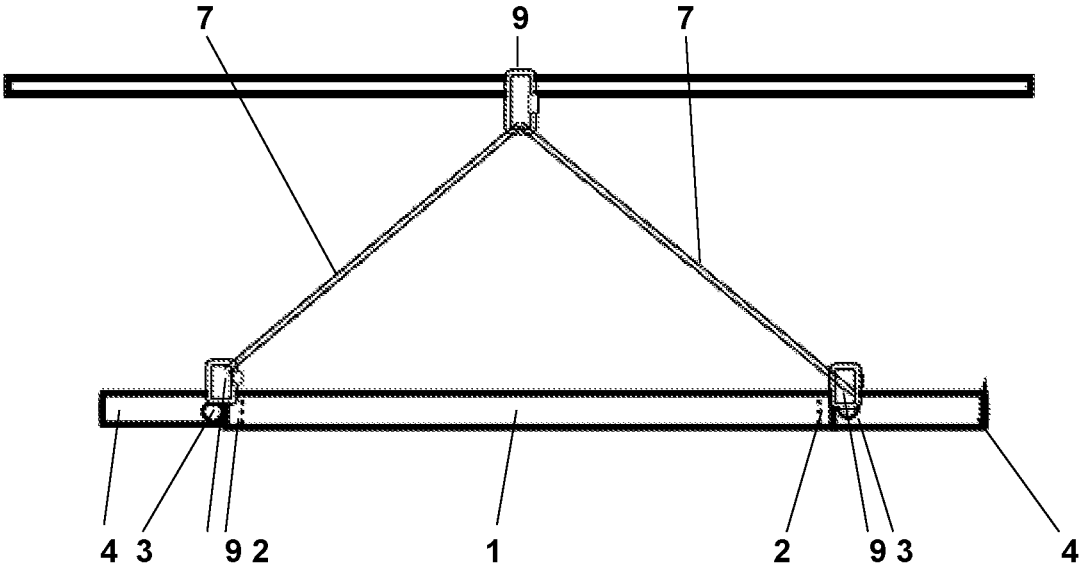

FIG. 11A is a front/back view of the ergonomic exercise grip structure barbell embodiment and inelastic flat strap 7 attached to an overhead structure by the carabiners 9 through the eyelets 3 in the weight bearing rods 4 and the metal wringed eyelets 8 in the strap 7.

Figure 12A:
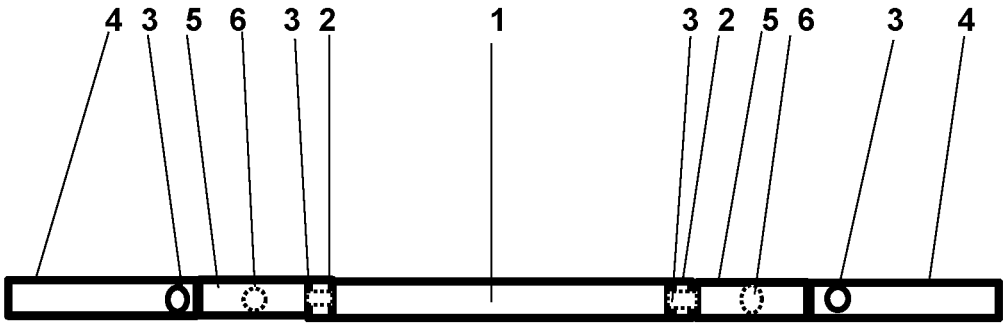

FIG. 12A is a side view of the ergonomic exercise grip structure with straight bars.

Figure 12B:
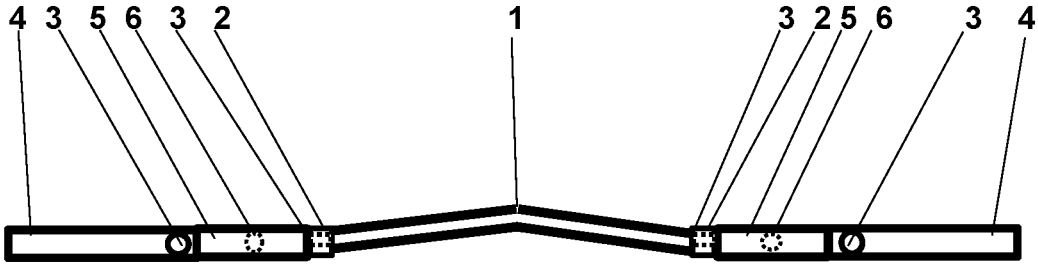

FIG. 12B is a side view of the ergonomic exercise grip structure with straight bent bars.

Figure 12C:
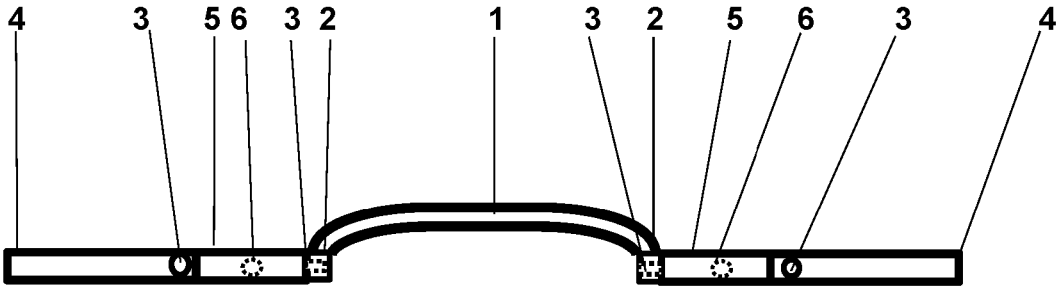

FIG. 12C is a side view of the ergonomic exercise grip structure with curved bars.

Figure 12D:
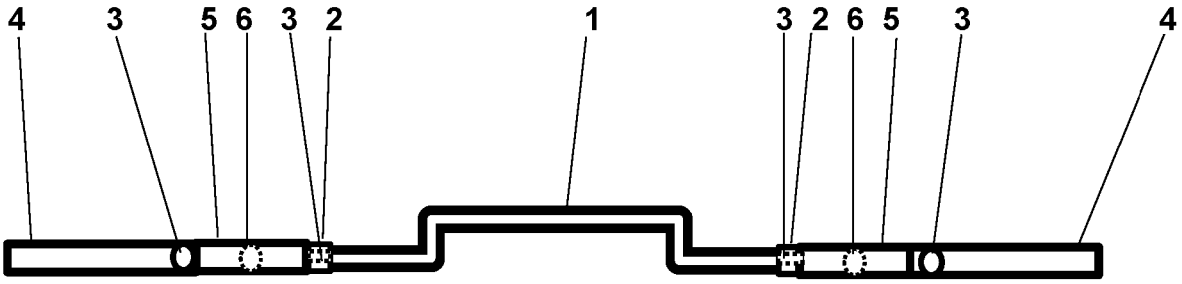

FIG. 12D is a side view of the ergonomic exercise grip structure with cambered bars.

Figure 12E:
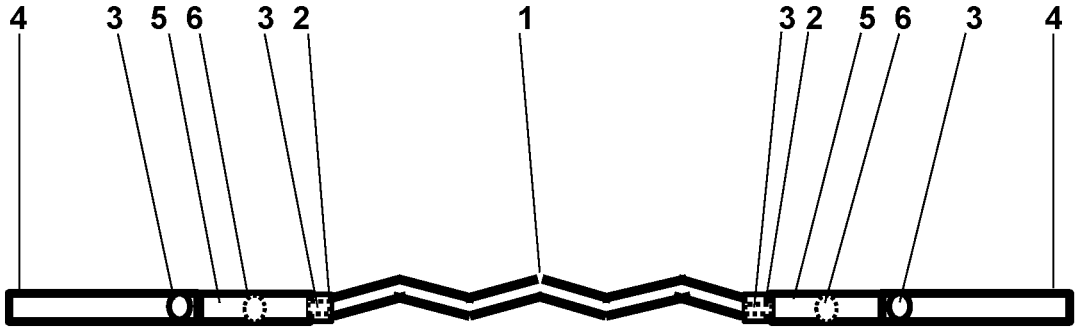

FIG. 12E is a side view of the ergonomic exercise grip structure with zig zag pattern EZ bars.

Table 2 provides an overview of the various embodiments of the ergonomic exercise grip structure including bar 1 type and stirrup handle 5 grip 6 types. The bars 1 may also have multiple lengths and shapes while the stirrup handles 5 may have multiple shapes. Rotating grips may have multiple positions including but not limited to neutral, standard and diagonal.

TABLE 2

| Embodiment | Bar Type Available | | | | | Stirrup Grips Available |
|---|---|---|---|---|---|---|
| Cable Attachment | Straight | Straight and Bent | Curved | Cambered | Zig Zag EZ | Not Applicable |
| Cable Attachment with Stirrups | Straight | Straight and Bent | Curved | Cambered | Zig Zag EZ | Fixed Single Bar Grip: Standard, Diagonal, Neutral<br>Rotating Single Bar Grip: Standard, Diagonal, Neutral<br>Rotating Dual Bar Grip: Standard, Diagonal, Neutral |
| Cable Attachment with Stirrups and Flat Join plate connecting the parallel bars in the center | Straight | Straight and Bent | Curved | Cambered | Zig Zag EZ | Fixed Single Bar Grip: Standard, Diagonal, Neutral<br>Rotating Single Bar Grip: Standard, Diagonal, Neutral<br>Rotating Dual Bar Grip: Standard, Diagonal, Neutral |
| Cable Attachment with Stirrups and weight Bearing Rods | Straight | Straight and Bent | Curved | Cambered | Zig Zag EZ | Fixed Single Bar Grip: Standard, Diagonal, Neutral<br>Rotating Single Bar Grip: Standard, Diagonal, Neutral<br>Rotating Dual Bar Grip: Standard, Diagonal, Neutral |
| Cable Attachment with Stirrups and weight Bearing Rods and Flat Join plate connecting the parallel bars in the center | Straight | Straight and Bent | Curved | Cambered | Zig Zag EZ | Fixed Single Bar Grip: Standard, Diagonal, Neutral<br>Rotating Single Bar Grip: Standard, Diagonal, Neutral<br>Rotating Dual Bar Grip: Standard, Diagonal, Neutral |
| Barbell | Straight | Straight | Curved | Cambered | Zig Zag EZ | Not Applicable |

TABLE 2-continued

| Embodiment | Bar Type Available | | | | | Stirrup Grips Available |
|---|---|---|---|---|---|---|
| | | and Bent | | | | |
| Barbell with Flat Join Plate in the middle | Straight | Straight and Bent | Curved | Cambered | Zig Zag EZ | Not Applicable |
| Dumbbell | Straight | Not Applicable | Not Applicable | Not Applicable | Not Applicable | Not Applicable |

DETAILED DESCRIPTION OF THE DRAWINGS

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding field of the invention, background, brief summary or the following detailed description.

The ergonomic exercise grip structure and detachable strap proposed in this application addresses the aforementioned challenges and shortfalls of single bar grip, Swiss bar, ergonomic structures and exercise strap devices as it provides a trainee with the means to exercise in a safe productive manner while reducing the potential for injury on a multitude of exercises including but not limited to bicep curls, triceps extensions, straight arm pullovers, squats, seated calf raises, bench presses, rows, dead lifts, overhead presses, jammer presses and hip thrusters by using free weight, body weight, cable and machine resistance.

The ergonomic exercise grip structure and detachable strap proposed in this application delivers these benefits by its unique structure which consists of two parallel bars 1 which are placed much closer together than those of a Swiss bar structure. The ergonomic exercise grip structure enables the close placement of the parallel bars 1 because there are no neutral perpendicular or diagonal hand grip bars that connect them. It is the absence of these connecting hand grip bars and the great distance they create between the parallel bars 1 that make this ergonomic exercise grip structure unique from any other single bar grip, Swiss bar or ergonomic bar structure in design, use and function.

These two parallel bars 1 in the ergonomic exercise grip structure are separated by a short distance which only allows for a prone or supine grip. This short distance prohibits a neutral grip as a trainee could not fit their hands in between the parallel bars 1 in the neutral position as there is not enough space and there are also no neutral hand grip bars for them to engage.

Unlike other ergonomic grip structures, the parallel bars 1 in the ergonomic exercise grip structure proposed in this application have multiple lengths and formats. These parallel bar formats include, but are not limited to, straight and horizontal (FIG. 12A), straight and bent on an angle greater than one degree but less than one hundred and eighty degrees (FIG. 12B), curved (FIG. 12C), cambered (FIG. 12D) and bent in a zig zag pattern found on EZ curl bars (Dymeck U.S. Pat. No. 2,508,567A)(FIG. 12E). The circumference of these bars 1 may have multiple widths and shapes, including, but not limited to round and circular, oval shaped, square, rectangular or triangular. These parallel bars 1 may be smooth or knurled, or smooth with knurled sections. These parallel bars 1 may also be rubber coated or have removable foam sleeves for grip and comfort. In the absence of rubberized bars or removable foam sleeves, a trainee may also wrap their wrists with a tensor bandage or any commercially available padded wrist strap or support.

Instead of neutral hand grip bars, the parallel bars 1 are joined by short flat joining plates 2 whose length and width enable them to serve only as a joining feature and not as a grip. These flat joining plates 2 connect the parallel bars 1 at their ends, in the middle, or both.

In all embodiments of the ergonomic exercise grip structure, the center of gravity is placed directly between the parallel bars 1 by the use of the centered eyelet 3 on the flat joining plates 2 or by weight bearing rods 4 placed on the outside ends in the middle of these flat joining plates 2 directly between the parallel bars 1. These weight bearing rods 4 have a grip section in their inner ends that provides the option to use a standard grip.

The short length and narrow width of the flat joining plates 2 prevents them from being used as a grip like a Swiss bar as a trainee would be unable to hold them in the neutral grip manner. Instead, the short length of these flat joining plates 2 separate the parallel bars 1 by a short distance. This short distance between the parallel bars 1 serves to create a hand insertion space between them which houses the center of gravity while only allowing for a prone or supine grip.

This hand insertion space between the parallel bars 1 enables a trainee to perform bicep curls, triceps extensions and straight arm pullovers with a prone or supine grip in an effective manner that eliminates the potential wrist strain of single bar structures while avoiding the dilutive mechanical leverage of Swiss Bar structures. This narrow hand insertion space houses the center of gravity provided by the eyelet 3 in the center of the flat joining plates 2 or by the weight bearing rods 4 placed in the center of the outside ends of the flat joining plates 2 placed directly between the parallel bars 1.

Since the center of gravity is placed directly between the two parallel bars 1, the trainee can elect to grip either one of the parallel bars 1 with their hands while allowing the second closer parallel bar 1 to rest on a small portion of their forearms just below the wrist as a support which enables them to keep their wrists in a straight, neutral position while successfully engaging the targeted muscles to perform the exercise as the narrow distance between the parallel bars 1 minimizes the use of mechanical leverage. Since the trainee can elect to use either parallel bar 1 as a grip or as a support, the bars 1 will be rubber coated or have removable foam sleeves to add comfort for both gripping and support. If more padding is needed, the trainee has the option to wrap their wrists with any number of commercially available wrists straps or tensor bandages. When engaged in this manner, the parallel bars 1 are perpendicularly oriented with respect to the hands and forearms of the trainee.

This ergonomic exercise grip structure also provides a trainee with the option of using the traditional grip provided by single bar grip structures by gripping only one of the bars with their hands in the prone or supine position as well as the option of using the fat grip by gripping both bars in their hands in the prone or supine position.

When a trainee performs a squat with the barbell or cable attachment embodiment of the ergonomic exercise grip structure, they will not have to choose between the high bar or low bar technique which places the barbell on their upper back above the spine of the scapula or below the spine of the scapula respectively. The ergonomic exercise grip structure described in this application provides a trainee with the best of both methods as both parallel bars 1 will more effectively rest on their upper back above and below the spine of the scapula with the center of gravity placed directly between the two parallel bars 1. This will provide the trainee with better balance and thoracic stability while making this exercise more effective and less risky.

The ergonomic exercise grip structure will also improve the seated calf raise exercise. It does so by the use of its narrowly spaced parallel bars 1 which evenly distribute the weight between them which improves balance and safety while reducing strain on the trainee's thighs. The narrow distance between the parallel bars 1 also reduces mechanical leverage while enhancing the stimulation of the targeted muscles. The application of rubber grips or removable foam pads will also reduce discomfort for the trainee. When engaged in this manner, the parallel bars 1 are perpendicularly oriented with respect to the thighs of the trainee when in the seated position and engage the front of the thighs at two points slightly above the knee.

The dumbbell version of the ergonomic exercise grip structure enables the performance of multiple exercises and the eyelets 3 in its weight bearing rods 4 also enable it to function as a single hand grip cable attachment (FIG. 9A). The dumbbell embodiment enables a trainee to rotate their hand while using the described grips while rotating grips 6 inside the stirrup handles 5 in the cable attachment and barbell embodiment may also rotate in addition to being in several fixed positions. These rotating grips 6 may consist of a single grip bar 6 or be a pair of parallel grip bars (dual grip bars) 6 which will be spaced apart just as the parallel bars 1 are which will enable the trainee to use the same grips that the parallel bars 1 offer while enabling the trainee to rotate their hands while performing exercises (FIG. 3F, 3G, 4F, 4G, 5F, 5G, 6F, 6G).

The ergonomic exercise grip structure will also improve the overhead press and hip thruster exercise as the detachable strap can attach the barbell or cable embodiment of the devise to an overhead bar, rod or beam at a height that the trainee can set since the strap is adjustable. This strap consists of an inelastic flat strap 7 (FIG. 10A) that is lined with perforated metal wringed eyelets 8 having a pair of ends separated by a length and a set of 3 carabiners 9. The strap has an odd number of perforated metal wringed eyelets 8 to ensure that there the resistance on the strap is balanced when tension is placed via a carabiner 9 through the center eyelet 3 (FIG. 11A). The Trainee may use more than three carabiners 9 if desired, but three carabiners enable the inelastic flat strap 7 to function in the manner claimed.

The strap is adjustable as loops may be formed by folding the strap 7 and securing them by inserting a carabiner 9 through both sections of the strap through the perforated metal wringed eyelets 8 in the strap 7.

These perforated metal wringed eyelets 8 may also be referred to by some in the trade as metal grommets as they are often associated with the stronger thicker materials that are being used in this strap 7 while eyelets may be associated with a number of materials both thick and strong and thinner and weaker. However, for the sake of simplicity and consistency, they will be referred to as perforated metal wringed eyelets 8 in this application.

The strap 7 can securely form an adjustable loop and wrap around a supporting structure or be attached to a structure by one of the carabiners 9. This enables the strap 7 to connect to the ergonomic exercise grip structure as the carabiners 9 go through the perforated metal wringed eyelets 8 in the strap and through the eyelets 3 on the flat join plates 2 or weight bearing rods 4. There are other straps that are used to suspend a barbell or cable attachment from an overhead structure, but they are not as safe as they only loop or wrap around the bar and do not actually attach to it in the manner proposed in this application. The strap 7 and carabiners 9 may also be used to attach other cable attachments not described in this application.

The combination of the ergonomic exercise grip structure and adjustable strap 7 will enable the trainee to perform multiple exercises including presses when the ergonomic exercise grip structure is securely suspended from an overhead structure by pressing it with a prone or supine grip or with a neutral thumbs up grip by pressing on the stirrup handle 5 grips 6 or the strap 7 itself. The overhead structure may consist of but is not limited to being a squat rack, chin up bar, cross fit rig or support beam. The trainee may also perform the jammer press by pressing the bar that is suspended by the detachable strap in a manner similar to how one pushes a swing set. The trainee may press the ergonomic exercise grip structure from a lower squat like position or from a higher pressing position. The height from which the ergonomic exercise grip structure is suspended is determined by the trainee as the strap 7 is adjustable.

This method of pressing from a squat like position is very similar to the Hammer Strength Ground Based Jammer machine (U.S. Pat. No. 5,554,089 and Hammer Strength, Strength Jammer Summer 1990 (4 pages)) where the trainee presses in a manner similar to pushing a swing set overhead except this version is not linear like the Jammer machine as the bar is suspended by the strap 7 which makes the exercise more effective as the trainee exercises on multiple planes which involves more stabilizer muscles and provides a superior workout while taking up far less space than a machine as it may be performed in an already existing structure.

A trainee may also use the ergonomic exercise grip structure and adjustable strap 7 to perform bench presses, shoulder presses, squats, rows and dead lifts in the traditional manner while using the strap 7 as a safety feature that catches the bar if they drop it or are unable to perform the exercise. The adjustable strap 7 also enables the trainee to set the range of motion they wish to train in by adjusting the height of the bar or cable attachment (FIG. 11A).

The trainee may also perform bench and shoulder press movements without the detachable strap 7 by attaching free weight plates or by using cable resistance with the barbell version. The trainee may perform bench and shoulder presses with the cable version by attaching the unit to a dual cable structure or by attaching free weights to the cable attachment by the use of the detachable strap 7 and carabiners 9.

The ergonomic exercise grip structure and detachable strap 7 also improves the performance of the hip thruster movement as the trainee performs the exercise in an upright vertical manner where they set the height of the barbell with the adjustable strap 7 so that it rests on their lower abdomen when they stand upright with their hips behind their ankles and perform a vertical hip thruster movement as they push their hips forward, pressing the suspended barbell forward which enables the development of the glute and hamstring muscles. If the barbell is too heavy, the trainee does not have to worry about it falling on them, as they only need to take a step back and they are out of harm's way as the detachable strap 7 functions as a safety feature.

Trainees may still perform the hip thruster movement in the traditional horizontal manner with the ergonomic exercise grip structure without the detachable strap 7 by attaching free weight plates or by using cable resistance with the barbell version. The trainee may also perform horizontal hip thrusters with the cable version by attaching the unit to a dual cable structure or by attaching free weights to the cable attachment by the use of the detachable strap 7.

The detachable strap 7 also functions as a cable attachment by itself as the carabiner 9 in the center of the strap 7 may attach to a cable pulley while the other ends of the strap 7 form secure loops around the limbs of a trainee by folding the strap 7 and securing them with a carabiner 9 which enables them to perform rear, side and front deltoid raises without the need to place the resistance directly in their hands which reduces wrist strain and improves muscle isolation. The strap 7 may be used to perform multiple exercises including, but not limited to cable pullovers, pulldowns, abdominal crunches, curls, triceps press downs, triceps extensions and leg kick backs. The strap 7 may also be used to perform body weight resistance exercises including but not limited to planks, crunches and seated leg curls when attached to an overhead structure. The strap 7 may also attach to free weights by forming attachment loops with the carabiners 9 to provide weight resistance to exercises if the trainee does not have access to a cable pulley.

This ergonomic exercise grip structure can be used in barbells, dumbbells, cable attachments, machine attachments and as a barbell with a cable attachment. The proposed ergonomic exercise grip structure with a detachable strap is very versatile and enables the performance of several exercises in a safe productive manner.

While the ergonomic exercise grip structure described above is made of several different components, an alternative means of construction would entail cutting or punching a single large thick steel plate in order to create a device that would resemble and function in the same manner as the other embodiments, however, this means of production would not be practical due to the high cost of materials and the amount of waste produced.

First Embodiment

The cable and machine attachment embodiment of the ergonomic exercise grip structure with a detachable strap comprises parallel bars 1 that are connected by flat join plates 2 with eyelets 3 in their center connecting the parallel bars 1 at the ends so it may attach to dual cable pulley structures found on cable crossover and functional trainer units (FIG. 1A). Another embodiment has as an additional flat join plate 2 with an eyelet 3 in its center connecting the parallel bars 1 in the middle which enables attachment to single cable pulley structures, giving the ergonomic exercise grip structure greater versatility (FIG. 2A).

In addition to cable pulleys, the detachable strap 7 enables the attachment of free weight plates and dumbbells to add resistance if a cable pulley system is unavailable which enables the cable attachment to provide free weight resistance and function like a barbell (FIG. 10A). The detachable flat strap 7 is made of a strong inelastic material that is lined with perforated metal wringed eyelets 8 having a pair of ends separated by a length and a set of carabiners 9. The strap 7 and carabiner 9 wrap around an overhead structure to form a secure attachment while the ends of the strap 7 may attach to the ergonomic exercise grip structures eyelets 3 via the carabiners 9. The strap 7 may also form adjustable loops around a trainees limbs when the carabiners 9 attach through the perforated metal wringed eyelets 8 (FIG. 11A).

As stated earlier, the parallel bars 1 in the cable attachment embodiment of the ergonomic exercise grip structure may have different lengths. The longer format would enable the trainee to grip the structure with both hands and the shorter format would only allow for a single hand grip. The circumference of these bars 1 may have multiple widths and shapes, including, but not limited to round and circular, oval shaped, square, rectangular or triangular.

There is also an embodiment of the ergonomic exercise grip structure cable attachment with stirrup style handles with a grip bar inside them attached to the outside ends of the flat joining plates 2 at the ends of the parallel bars 1 (FIG. 3A). These stirrup handles 5 have an eyelet 3 in the center of their inside end which is aligned with the eyelet 3 in the center of the flat join plates 2 that join the parallel bars 1. The grip bars 6 inside these stirrup handles 5 may be placed at a multitude of fixed or rotating angles which provide the trainee with the option to employ neutral and diagonal grips in addition to the main prone and supine grips that the parallel bars 1 provide. These grip bars 6 placed inside the stirrup handles 5 may be placed so that they are perpendicular to the parallel bars 1 to enable a neutral grip (FIG. 3A). These grip bars 6 inside the stirrup handles 5 may also be placed on an angle that is diagonal to the parallel bars 1 providing the trainee with the option to use a diagonal grip. These diagonal angles can range from 10 to 80 degrees (FIG. 3D). It is also possible to use stirrup handles 5 that have adjustable rotating grips 6 inside them that can lock in place which provide standard, neutral and diagonal grips. These stirrup handles 5 can be in multiple shapes including but not limited to circular, half circles, square, rectangular or triangular and have an eyelet 3 in their inside end that is aligned with the eyelet 3 in the flat join plates 2 to enable secure cable attachment. These rotating grips 6 may consist of a single grip bar 6 or be a pair of parallel grip bars 6 which will be spaced apart just as the parallel bars 1 are which will enable the trainee to use the same grips that the parallel bars 1 offer while enabling the trainee to rotate their hands while performing exercises (FIG. 3F, 3G, 4F, 4G, 5F, 5G, 6F, 6G).

A further embodiment of the ergonomic exercise grip structure cable and machine attachment further comprises 1 or 2 inch in diameter standard or Olympic style weight bearing rods 4 which have eyelets 3 in the center of their inside ends that are perpendicular to the weight bearing rods 4 and parallel bars 1 (FIG. 5A). These 1 or 2 inch in diameter standard or Olympic style weight bearing rods 4 are connected to the center of the outside ends of the stirrup handles 5 midway between the parallel bars 1, extending outwards horizontally. These weight bearing rods 4 have a grip section in their inner ends that provides the option to use standard grip which enables the cable and machine attachment embodiment of the ergonomic exercise grip structure to function as a barbell by providing the trainee with the option to employ a prone or supine grip with the parallel bars 1 or grip section of these weight bearing rods 4 or a multitude of grips inside the stirrup handles 5. The detachable strap 7 enables this embodiment to be attached to overhead structures such as poles, rods or support beams to enable the performance of multiple exercises including but not limited to bench presses, squats, shoulder presses, jammer presses, hip thrusters, dead lifts and rack pulls (FIG. 11A).

As mentioned earlier, the detachable strap 7 may also function as an attachment by itself as a trainee may attach it to a cable pulley or to free weights and forms loops around their limbs to perform exercises. The detachable strap 7 may also be used to perform body weight exercises.

Second Embodiment

The barbell embodiment of the ergonomic exercise grip structure with a detachable strap 7 has two flat join plates 2 which connect the parallel bars 1 at their ends which do not have eyelets 3. Instead, these flat join plates 2 have 1 or 2 inch in diameter standard or Olympic style weight bearing rods 4 attached to the center of their outside ends placed directly between the parallel bars 1. These weight bearing rods 4 have a grip on their inner section which connects to the flat joining plate which enables a standard grip. These weight bearing rods 4 have eyelets 3 in the center of their inside ends of the grip section close to the flat join plates 2. These eyelets 3 are perpendicular to the weight bearing rods 4 and parallel bars 1 that are connected to the center of the outside ends of the join plate 2 midway between the parallel bars 1 which enables the barbell to function as a cable or machine attachment. This creates two identical lateral portions consisting of flat joining plates 2 and weight bearing rods 4 and a medial portion which consists of the parallel bars 1 without any perpendicular or diagonal grip bars connecting them (FIG. 7A).

Just as in the cable and machine attachment embodiments, these parallel bars 1 can be straight and horizontal (FIG. 12A), straight and bent on an angle greater than one degree but less than one hundred and eighty degrees (FIG. 12B), curved (FIG. 12C), cambered (FIG. 12D) or bent in a zig zag pattern found on EZ curl bars (Dymeck U.S. Pat. No. 2,508,567A) (FIG. 12E). The circumference of these bars 1 may have multiple widths and shapes, including, but not limited to round and circular, oval shaped, square, rectangular or triangular. These bars may be smooth or knurled, or smooth with knurled sections. The barbell embodiment may be of varying lengths. The longest would be the standard seven foot length of most commercial barbells which fit on squat racks and various training stations as well as shorter three, four, five and six foot length barbells that are stored on various horizontal and vertical barbell racks.

There are multiple embodiments of the barbell version of the ergonomic exercise grip structure that have additional features such as an additional flat join plate 2 with an eyelet 3 in its center joining the parallel bars 1 in the middle which enables it to function as a barbell with a cable or machine attachment for single pulley structures in addition to the eyelets 3 in the weight bearing roads which enable attachment to dual pulley structures (FIG. 8A).

The barbell embodiment of the ergonomic exercise grip structure may also take a form that does not have flat join plates 2 that connect the parallel bars 1 to the weight bearing rods 4. Instead, the outside ends of the parallel bars 1 are bent towards each other so they will attach directly to the weight bearing rods 4 in a triangular pattern (FIG. 7D).

A further embodiment of the barbell embodiment of the ergonomic exercise grip structure and detachable strap 7 configures the parallel bars 1, flat join plates 2 and weight bearing rods 4 so that they take the form of a dumbbell. The eyelets 3 in the weight bearing rods 4 enable the dumbbell to function as a single hand grip cable attachment (FIG. 9A).

The detachable strap 7 and carabiners 9 enable the barbell embodiment to attach to overhead structures to perform various exercises including but not limited to squats, bench presses, presses, jammer presses and hip thrusters and to also function as a separate cable attachment that can provide resistance from cable pulleys, machines or free weights.

What is claimed is:

1. An ergonomic exercise grip structure, said structure comprising:

a first bar, a second bar parallel to the first bar, said parallel bars have removable form sleeves to add comfort for both gripping and support;

flat joining plates each having an eyelet in a center of the joining plate which connects the first and second parallel bars at their respective ends, giving said parallel bars two identical lateral portions without any perpendicular or diagonal grip bars connecting said parallel bars;

said eyelets of said flat joining plates are configured to act as a cable attachment or a machine attachment to serve as a source of resistance and center of gravity by applying said resistance evenly between said parallel bars when each is connected to a source of resistance;

axes of said eyelets are parallel to said parallel bars and said parallel bars are separated by a distance defined by a length of said flat joining plates;

wherein said distance is configured to create a hand insertion space between said parallel bars;

an inelastic detachable flat strap lined with perforated metal ringed eyelets having a pair of ends separated by a length and a set of carabiners attached to said strap through said eyelets which line said strap to form an adjustable loop such that the grip structure and strap are configured to be suspended from an overhead structure in order to enable the performance of exercises;

said inelastic flat strap and carabiners are further configured to enable attachment of free weight plates to said ergonomic exercise grip structure;

said carabiners enable said inelastic flat strap to detach from said ergonomic exercise grip structure and are further configured to attach to cable pulleys and function as a cable attachment when said carabiners attach to said metal eyelets on said inelastic flat strap enabling it to form adjustable loops around a trainees limbs to enable performance of exercises;

wherein said overhead structure includes a pole, a rod, or a support beam.

2. The ergonomic exercise grip structure in claim 1, further comprising stirrup handles with a grip bar inside them and an eyelet in a center of inside ends; wherein said eyelets in the center of said flat joining plates are line up with said eyelets in the center of the inside ends of said stirrup handles; and a fastener extending through the hands and flat joining plates to secure them together.

3. The ergonomic exercise grip structure in claim 2 further comprising 1 or 2 inch in diameter standard or Olympic style weight bearing rods which have eyelets in a center of inside ends that are perpendicular to said weight bearing rods and parallel bars connected to the center of the outside ends of said stirrup handles midway between said parallel bars, extending outwards horizontally.

4. The ergonomic exercise grip structure in claim 3 further comprising a third flat join plate with an eyelet in its center connecting said parallel bars in a middle of said parallel bars.

5. The ergonomic exercise grip structure in claim 1 further comprising a third flat joining plate with an eyelet in its center connecting said parallel bars in a middle of said parallel bars.

6. An ergonomic exercise grip structure, said structure comprising:

a first bar, a second bar parallel to the first bar, said parallel bars have removable form sleeves to add comfort for both gripping and support;

flat joining plates each having an eyelet in a center of the joining plate which connects the first and second parallel bars at their respective ends, giving said parallel bars two identical lateral portions without any perpendicular or diagonal grip bars connecting said parallel bars;

1 or 2 inch in diameter standard or Olympic weight bearing rods which have eyelets in a center of inside ends that are perpendicular to said weight bearing rods and parallel bars connected to the center of the outside ends of said stirrup handles midway between said parallel bars, extending outwards horizontally giving said parallel bars two identical lateral portions;

said flat joining plates and weight bearing rods are configured to act as a barbell;

said weight bearing rods are parallel to said parallel bars;

said weight bearing rods are configured to serve as the source of resistance and center of gravity by applying said resistance evenly between said parallel bars;

said weight bearing rods have a grip section on inner ends which connect to said flat joining plates;

said eyelets of said flat joining plates are configured to act as a cable attachment or a machine attachment to serve as a source of resistance and center of gravity by applying said resistance evenly between said parallel bars when each is connected to a source of resistance;

axes of said eyelets are parallel to said parallel bars and said parallel bars are separated by a distance defined by a length of said flat joining plates that connects said parallel bars at respective ends;

wherein said distance is configured to create a hand insertion space between said parallel bars;

an inelastic detachable flat strap lined with perforated metal ringed eyelets having a pair of ends separated by a length and a set of carabiners attached to said strap through said eyelets which line said strap to form an adjustable loop such that the grip structure and strap are configured to be suspended from an overhead structure in order to enable the performance of exercises;

said inelastic flat strap and carabiners are further configured to enable attachment of free weight plates to said ergonomic exercise grip structure;

said carabiners enable said inelastic flat strap to detach from said ergonomic exercise grip structure and are further configured to attach to cable pulleys and function as a cable attachment when said carabiners attach to said metal eyelets on said inelastic flat strap enabling it to form adjustable loops around a trainees limbs to enable performance of exercises;

wherein said overhead structure includes a pole, a rod, or a support beam.

7. The ergonomic exercise grip structure in claim 6 further comprising a third flat joining plate with an eyelet in its center connecting said parallel bars in a middle of said parallel bars.

8. The ergonomic exercise grip structure in claim 6 wherein said parallel bars, flat joining plates and weight bearing rods are configured to act as a dumbbell.

* * * * *